US006163673A

United States Patent [19]

Shindo

[11] Patent Number: 6,163,673

[45] Date of Patent: Dec. 19, 2000

[54] LIQUID DEVELOPING APPARATUS HAVING CLEANING ELECTRODE FOR REMOVING TONER PARTICULATES

[75] Inventor: Kazunori Shindo, Niigata, Japan

[73] Assignee: NEC Corporation, Tokyo, Japan

[21] Appl. No.: 09/345,393

[22] Filed: Jul. 1, 1999

[30] Foreign Application Priority Data

Jul. 2, 1998 [JP] Japan ..... 10-187553

[51] Int. Cl.[7] ..... G03G 15/10

[52] U.S. Cl. ..... 399/237; 399/239; 399/240

[58] Field of Search ..... 399/237, 239, 399/240, 241, 233; 430/117, 118, 119

[56] References Cited

U.S. PATENT DOCUMENTS 5,666,614 9/1997 Kuramochi et al. ..... 399/233
5,826,149 10/1998 Horri et al. ..... 399/240

FOREIGN PATENT DOCUMENTS 8-15993 1/1996 Japan .

*Primary Examiner*—Arthur T. Grimley
*Assistant Examiner*—Hoan Tran
*Attorney, Agent, or Firm*—Ostrolenk, Faber, Gerb & Soffen, LLP

[57] ABSTRACT

A liquid developing apparatus includes a developing roller for developing a latent image on a surface of a photoconductor belt by using a liquid developer. The developing roller is opposed to the surface of the photoconductor belt. A cleaning electrode is provided to remove toner particulates from the surface of the developing roller. The cleaning electrode is opposed to the developing roller with a predetermined distance. A first voltage and a second voltage are applied to the developing roller and the cleaning electrode, respectively. The second voltage applied to the cleaning electrode has an AC component to remove toner particulates from the developing roller.

9 Claims, 1 Drawing Sheet

LIQUID DEVELOPING APPARATUS HAVING CLEANING ELECTRODE FOR REMOVING TONER PARTICULATES

BACKGROUND OF THE INVENTION

1. Field of the Invention

The present invention relates to a liquid developing apparatus used in image recording apparatuses such as printers and copy machines, and in particular to a technique for removing toner adhering to a surface of a developing roller.

2. Description of the Related Art

A liquid developing apparatus develops an electrostatic latent image formed on the surface of a photosensitive substance by toner contained in a liquid developer (liquid developer) adhering to the surface of a developing roller. If there is left toner which is not used for development on the surface of the developing roller, then stable development of the electrostatic latent image cannot be obtained.

Conventionally, therefore a cleaning or squeezing roller is provided to rub the surface of the developing roller (see Japanese Patent Unexamined Publication No. 8 15993). The cleaning roller rubs and removes toner adhering to the surface of the developing roller. As such a cleaning roller, a roller having nonwoven fabric such as cotton wound around it may be used. Further, a foam roller made of urethane may be used. Furthermore, a brush roller made of an acrylic resin, nylon, rayon, or the like may be used.

In a conventional removing method, however, the cleaning roller rubs the surface of the developing roller while the cleaning roller is being wetted with the liquid developer. Therefore, the cleaning roller is likely to have stain and clog. It is thus difficult to hold desired cleaning performance over a long period of time. For keeping the image quality constant, therefore, it becomes necessary to replace the cleaning roller frequently, resulting in increased cost. From the viewpoint of facilitating the maintenance as well, improvement is desired.

SUMMARY OF THE INVENTION

It is an object of the present invention to provide a liquid developing apparatus which can achieve stable development of an electrostatic latent image on a photosensitive substance.

According to the present invention, in view of the fact that toner particulates adhering to a surface of a developing roller are charged, an AC (alternating current) electric field or an electric field composed of an AC electric field superimposed with a DC (direct current) electric field is applied to the developing roller to remove the toner particulates from the surface of the developing roller.

A liquid developing apparatus includes a developing roller for developing an electrostatic latent image on a surface of a photoconductor member by using a liquid developer. The developing roller is opposed to the surface of the photoconductor member with a first predetermined distance. Further, a cleaning electrode is provided to remove toner particulates from a surface of the developing roller. The cleaning electrode is opposed to the developing roller with a second predetermined distance. A first voltage and a second voltage are applied to the developing roller and the cleaning electrode, respectively. The second voltage applied to the cleaning electrode has an AC (alternating current) component with a predetermined peak-to-peak amplitude and a predetermined frequency.

According to another aspect of the present invention, the electrostatic latent image is developed on the surface of the photoconductor member by applying a first voltage to the developing roller rotating in a direction corresponding to movement of the photoconductor member, and a vibrating electric field is applied on the developing roller to remove toner particulates from the developing roller.

DESCRIPTION OF THE PREFERRED EMBODIMENTS

Figure 1:
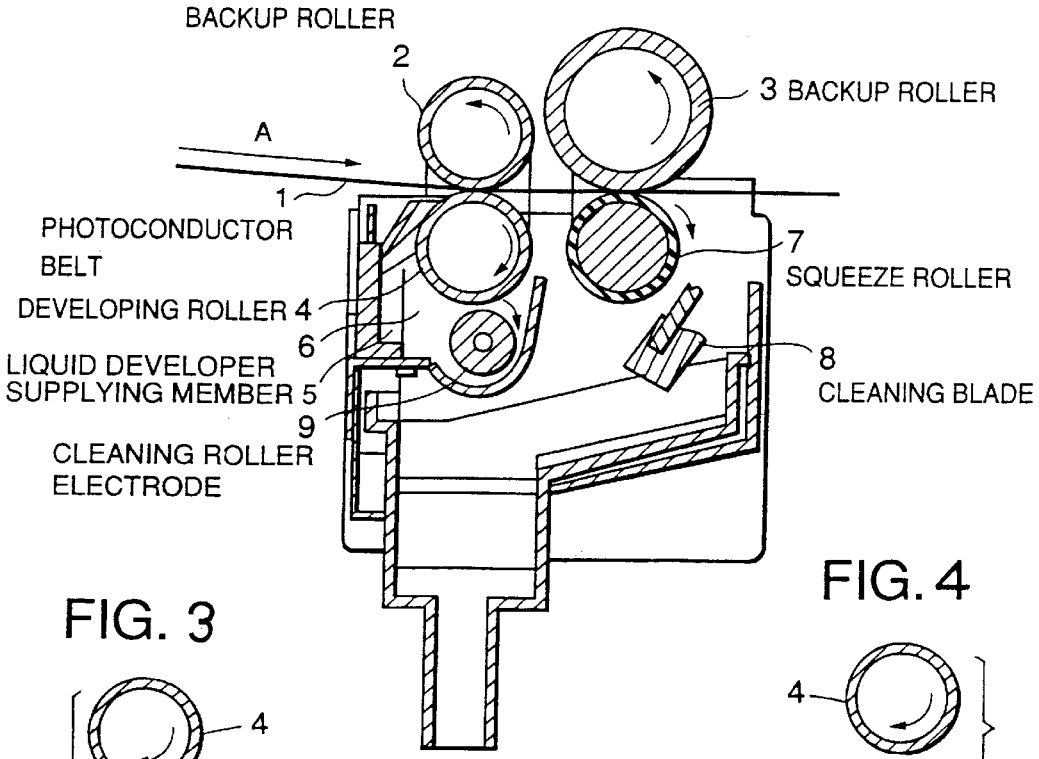
FIG. 1 is a sectional view of a liquid developing apparatus according to an embodiment of the present invention.

Referring to FIG. 1, in a developing apparatus according to an embodiment of the present invention, a photoconductor (or photoreceptor) belt 1 is used as a photosensitive material on which a latent image can be formed. For example, the photoconductor belt 1 is formed by depositing a photo-charge generation layer, a charge transportation layer, and a protection layer over a belt-shaped base.

In a conveyance path of the photoconductor belt 1 of the illustrated example, a backup roller 2 is disposed on the entrance side of the developing apparatus and a backup roller 3 is disposed on the exit side of the developing apparatus. The backup rollers 2 and 3 are driven and rotated in the counterclockwise direction in this figure. The photoconductor belt 1 entering the conveyance path from the left side of the illustrated figure is guided by lower peripheries of the backup rollers 2 and 3, and forwarded to the right as indicated by an arrow A.

Under the backup roller 2 located on the entrance side, a developing roller 4 is disposed so as to be opposed to a surface of the photoconductor belt 1 guided in movement by the lower periphery of the backup roller 2, via a predetermined space kept between the developing roller 4 and the surface of the photoconductor belt 1. The developing roller 4 is driven and rotated in the clockwise direction. A distance between the photoconductor belt 1 and the developing roller 4 is in the range of 100 to 200 $\mu$m. In addition, the developing roller 4 is made of conductive material such as metal, preferably stainless steel. The developing roller 4 is supplied with a high DC voltage as described later (see FIG. 2).

On a side wall of the casing near the developing roller 4, a liquid developer supplying member 5 is provided. The liquid developer supplying member 5 supplies a liquid developer to the developing roller 4. The liquid developer is formed by mixing toner particulates and a liquid carrier. When the liquid developer is supplied to the developing roller 4, a layer of the liquid developer is formed on the surface of the developing roller 4. A lower part of the developing roller 4 is immersed in a liquid developing reservoir 6. In other words, the liquid developer supplying member 5 is provided in order to certainly form a liquid developer layer on the surface of the developing roller 4.

Moreover, under the backup roller 3 of the exit side, a squeeze roller 7 is disposed so as to be in contact with the surface of the photoconductor belt 1 guided in movement by the lower periphery of the backup roller 3. The squeeze roller 7 is driven and rotated in the clockwise direction.

The squeeze roller 7 is a rubber roller having a rubber layer formed on the surface thereof. The rubber layer has an elastic body of urethane, EPDM, nitrile, or the like. The squeeze roller 7 has a Shore-hardness in the range of 30 to 60 degrees, and pressure welding force per unit length in the range of 200 to 500 gf/cm.

Under the squeeze roller 7, a cleaning blade 8 is disposed. During the developing operation, the cleaning blade 8 is in a position separated from the surface of the squeeze roller 7. When the developing operation is finished, however, the cleaning blade 8 is driven so as to come in contact with the surface of the squeeze roller 7.

According to the present embodiment, a cleaning roller electrode 9 is disposed under the developing roller 4 and in the liquid developer reservoir 6 such that the rotation axis of the cleaning roller electrode 9 may be in parallel to that of the developing roller 4. In the illustrated example, the cleaning roller electrode 9 is driven and rotated in the same direction as that of the developing roller 4. The cleaning roller electrode 9 is made of conductive material such as metal, preferably stainless steel. The cleaning roller electrode 9 is disposed so as to be opposed to the surface of the developing roller 4 via spacing in the range of approximately 0.1 to 0.3 mm. The cleaning roller electrode 9 is connected to an AC power supply (see FIG. 2).

Figure 2:
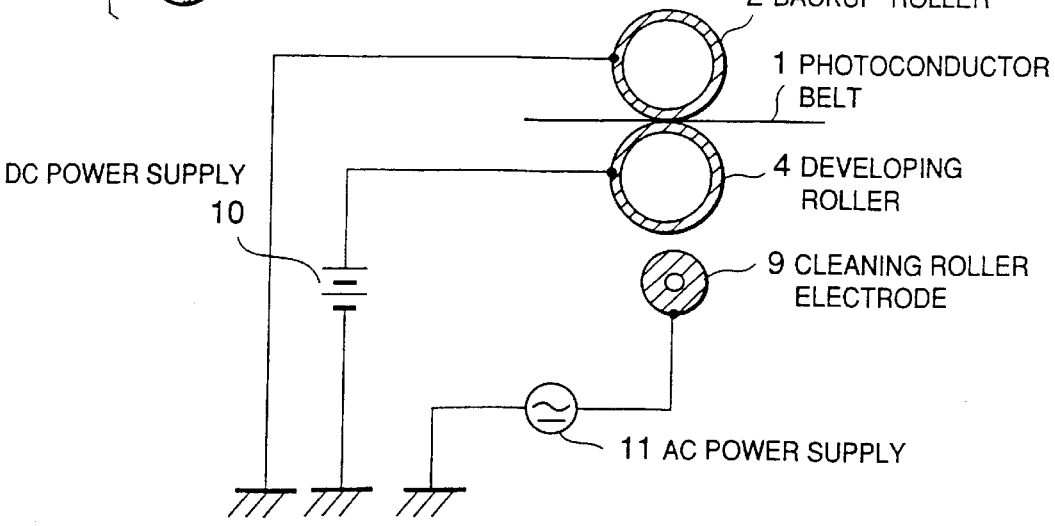
FIG. 2 is a schematic diagram showing an electric circuit of the embodiment.

As shown in FIG. 2, the backup roller 2 is grounded and a high DC voltage in the range of 300 to 500 V is applied to the developing roller 4 by a DC power supply 10. For example, in the case of a gap between the backup roller 2 and the developing roller 4 being 0.15 mm, the DC voltage is in the range of 400 to 600 V. The cleaning roller electrode 9 is supplied with an AC voltage by an AC power supply 11. The AC voltage is in the range of 300 to 1,000 Vpp and has a frequency ranging from 5 to 500 Hz.

Hereafter, an operation of the present embodiment will be described. The photoconductor belt 1 is subjected to exposure processing on the left outside of FIG. 1, and fed to the developing apparatus in such a state that the photoconductor belt 1 has an electrostatic latent image formed on the surface thereof. The potential on the surface of the photoconductor belt 1 is 600 V on non-image portions having no electrostatic latent images and is in the range of 50 to 120 V on the image portion having an electrostatic latent image.

From the liquid developer supplying member 5, the liquid developer which is a mixture of toner and liquid carrier is supplied onto the surface of the developing roller 4. Since the developing roller 4 rotates in the clockwise direction, a layer of fresh liquid developer is always formed on the surface of the developing roller 4 opposed to the photoconductor belt 1.

Since the developing roller 4 has a DC voltage ranging from 300 to 500 V and the backup roller 2 is grounded, an electric field for developing the electrostatic latent image is generated between the developing roller 4 and the surface of the photoconductor belt 1 moving in the direction of the arrow A opposed to the developing roller 4. The direction of the electric field in the image portion is directed from the developing roller 4 to the photoconductor belt 1. As a result, toner having positive charge sticks to the photoconductor belt 1. On the other hand, the direction of the electric field in the non-image portions such as white background is directed from the photoconductor belt 1 to the developing roller 4. As a result, the toner remains adhering to the surface of the developing roller 4.

In this way, while the photoconductor belt 1 is advanced and guided by the backup rollers 2 and 3, the latent image on the surface thereof is developed by the liquid developer existing on the developing roller 4. A toner image obtained immediately after the developing has a toner density in the range of 20 to 50%.

The surface of the photoconductor belt 1 after the development is subjected to pressure in the range of 1 to 2 kgf/cm$^4$ by the squeeze roller 7 to remove excess liquid carriers located on the photoconductor belt 1. Thereby, the toner density on the photoconductor belt 1 increases to the range of 50 to 80%. The toner on the photoconductor belt 1 is changed in property from a liquid to a semi-solid because of mutual agglomeration force, and is semi-fixed on the photoconductor belt 1.

Since the surface of the squeeze roller 7 is stained by excess liquid developer, the surface of the squeeze roller 7 is cleaned by using the cleaning blade 8 when printing is finished. In the case of consecutive printing of 10 sheets or paper, the term "when printing is finished" means "when printing of all 10 sheets of paper is finished."

In the same way as the developing roller, an AC voltage having a predetermined voltage and a predetermined frequency is always applied to the cleaning roller electrode 9. As a result, an AC electric field is applied to the surface of the developing roller 4 opposed to the cleaning roller electrode 9.

Toner particles in the liquid developer have positive electric charges. Toner which adheres to the surface of the developing roller 4 once is dispersed again by vibration caused by an AC electric field. In other words, the toner stuck to the surface of the developing roller 4 is removed and dropped into the liquid developer reservoir 6. At this time, the cleaning roller electrode 9 is being rotated and therefore the liquid developer layer on the surface of the developing roller 4 is agitated, resulting in efficiently promoted toner removing operation.

In parallel with the developing operation of the developing roller 4, the toner removing operation can be performed. The developing roller 4 can always conduct the developing operation by using a fresh liquid developer with excess toner removed. Therefore, the image density of the photoconductor belt 1 is stably kept in a constant and good state.

In the embodiment as described above, the AC voltage is applied to the cleaning roller electrode 9 to generate the AC electric field between the developing roller 4 and the cleaning roller electrode 9. Alternatively, a DC voltage may be superposed on the AC voltage so that the potential of the cleaning roller electrode 9 is lower than that of the developing roller 4 to which the high DC voltage is applied by the DC power supply 10. Since the AC voltage is biased by such a DC component, toner stuck to the surface of the developing roller 4 is separated from effectively, and the toner removal can be conducted rapidly. In the case where a gap between the cleaning roller electrode 9 and the developing roller 4 is 0.15 mm, the DC voltage may be determined in the range of 400 to 600 V. Similarly to the case where only the AC electric field is used, an optimum electric field is determined empirically taking into account a gap between the developing roller 4 and the cleaning roller electrode 9.

Figure 3:
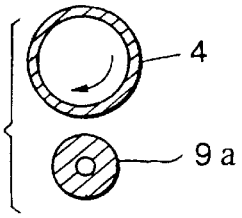
FIG. 3 is a partial sectional view showing an alternative embodiment of a cleaning electrode used in the apparatus of FIG. 1.
Figure 4:
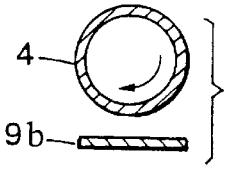
FIG. 4 is a partial sectional view showing a further alternative embodiment of a cleaning electrode used in the apparatus of FIG. 1.

Further, an example of a rotating cleaning roller electrode 9 has been described in anticipation of the effect of agitating the liquid developer. Alternatively, a fixed cylindrical electrode 9*a*, as shown in FIG. 3, or a fixed plate electrode 9*b*, as shown in FIG. 4, or a fixed plate electrode may also be used. It is a matter of course that each of these fixed electrodes is disposed so that its longitudinal direction will be in parallel to the surface of the developing roller 4 (exactly speaking, the rotation axis of the developing roller 4).

Further, the disposition position of the roller electrode or the fixed electrode, i.e., the cleaning electrode is not restricted into the liquid developer reservoir 6, but the cleaning electrode may be disposed anywhere so long as it can face the surface of the developing roller 4.

Furthermore, the present embodiment has been described by referring to an apparatus using a photoconductor belt in due consideration of color printing. This is because in the apparatus using a photoconductor belt a printer of tandem system can be implemented easily by arranging developers of yellow, magenta, cyan, and black colors in order and superposing colors one after another.

However, this does not deny that the above-described cleaning electrodes can be applied in the same way to an apparatus using a photosensitive drum.

In the liquid developing apparatus according to the present invention, an AC electric field, or an electric field formed by superposing a DC electric field thereto is applied to the surface of the developing roller. Therefore, the toner adhering to the surface of the developing roller is easily removed therefrom. In the present invention, therefore, the frequency of part replacement can be substantially reduced. Furthermore, the maintenance is facilitated and the cost can be reduced. In addition, the image quality can be maintained with high stability over a long period of time.

What is claimed is:

1. A liquid developing apparatus using a liquid developer including toner particulates, comprising:

a developing roller for developing an electrostatic latent image on a surface of a photoconductor member by using a liquid developer, wherein the developing roller is opposed to the surface of the photoconductor member with a first predetermined distance;

a liquid developer reservoir for storing the liquid developer;

a liquid developer supplying member for supplying the liquid developer to the developing roller;

a cleaning electrode for removing toner particulates from a surface of the developing roller, wherein the cleaning electrode is opposed to the developing roller with a second predetermined distance and the cleaning electrode is positioned below the developing roller within the liquid developer reservoir; and a power supply for applying a first voltage and a second voltage to the developing roller and the cleaning electrode, respectively, the second voltage applied to the cleaning electrode having an AC (alternating current) component with a predetermined peak-to-peak amplitude and a predetermined frequency.

2. A liquid developing apparatus according to claim 1, wherein the second voltage is an AC voltage.

3. A liquid developing apparatus according to claim 1, wherein the second voltage is formed by superposing an AC voltage on a DC (direct current) voltage.

4. A liquid developing apparatus according to claim 1, wherein the cleaning electrode is a roller-shaped rotatable electrode.

5. A liquid developing apparatus according to claim 1, wherein the cleaning electrode is rotated in the same direction as the developing roller.

6. A liquid developing apparatus according to claim 1, wherein the cleaning electrode is a rod-shaped fixed electrode.

7. A liquid developing apparatus according to claim 1, wherein the cleaning electrode is a plate-shaped fixed electrode.

8. A liquid developing apparatus using a liquid developer including toner particulates, comprising:

a developing roller for developing an electrostatic latent image on a surface of a photoconductor member by using a liquid developer, wherein the developing roller is opposed to the surface of the photoconductor member with a first predetermined distance;

a liquid developer supplying member for supplying the liquid developer to the developing roller;

a cleaning roller electrode for removing toner particulates from a surface of the developing roller, wherein the cleaning roller electrode is rotatably opposed and parallel to the developing roller with a second predetermined distance;

a liquid developer reservoir for storing the liquid developer, wherein the cleaning roller electrode is positioned below the developing roller within the liquid developer reservoir;

a squeezing roller for squeezing the surface of the photoconductor member on which the electrostatic latent image has been developed by the developing roller to remove excess liquid developer from the surface of the photoconductor member; and a power supply for applying a first voltage and a second voltage to the developing roller and the cleaning roller electrode, respectively, the second voltage applied to the cleaning roller electrode having an AC (alternating current) component with a predetermined peak-to-peak amplitude and a predetermined frequency.

9. A liquid developing apparatus according to claim 1, wherein the cleaning electrode rotates in the same direction as the developing roller.

* * * * *